United States Patent [19]

Grimm et al.

[11] Patent Number: 4,551,947

[45] Date of Patent: Nov. 12, 1985

[54] DEVICE FOR HONING WORKPIECES

[75] Inventors: Hans Grimm, Esslingen-Berkheim; Hermann Fingerle, Lenningen, both of Fed. Rep. of Germany

[73] Assignee: Maschinenfabrik Gehring Gesellschaft mit beschränkter Haftung & Co. Kommanditgesellschaft, Ostfildern, Fed. Rep. of Germany

[21] Appl. No.: 516,881

[22] Filed: Jul. 25, 1983

[30] Foreign Application Priority Data

Jul. 27, 1982 [DE] Fed. Rep. of Germany ..... 3227924

[51] Int. Cl.[4] ..... B24B 33/02

[52] U.S. Cl. ..... 51/34 H; 408/127; 408/141; 408/709

[58] Field of Search ..... 51/34 H, 34 F, 34 R, 51/165.93, 169, 290, 227 R; 464/78, 81, 147, 180, 179, 19; 403/113, 112, 116; 175/320; 408/127, 124, 141, 709

[56] References Cited

U.S. PATENT DOCUMENTS

| | | | |
|---|---|---|---|
| 2,251,607 | 8/1941 | Astrowski et al. | 51/34 H |
| 3,023,593 | 3/1962 | Nallinger | 464/147 |
| 3,274,798 | 9/1966 | Wiggins, Jr. | 464/180 |
| 3,499,299 | 3/1970 | Hector | 464/81 |
| 3,557,492 | 1/1971 | Greenberg | 51/227 R |
| 3,791,169 | 2/1974 | Wright | 464/180 |
| 4,420,912 | 12/1983 | Gehring | 51/227 R |

FOREIGN PATENT DOCUMENTS

| | | | |
|---|---|---|---|
| 1351163 | 4/1974 | United Kingdom | 408/127 |
| 0300303 | 3/1972 | U.S.S.R. | 51/34 H |
| 0731118 | 4/1980 | U.S.S.R. | 464/147 |

*Primary Examiner*—Frederick R. Schmidt
*Assistant Examiner*—Robert A. Rose
*Attorney, Agent, or Firm*—Becker & Becker, Inc.

[57] ABSTRACT

A device for honing workpieces. The device includes a rotatable and axially reciprocating honing tool which is guided by an upper and a lower end section in corresponding bearings of a workholding fixture, and also includes a drive rod between the honing tool and a machine spindle. This drive rod is flexible in the radial direction, which prevents out-of-balance at high rotational speeds of the honing tool as a result of excessive mass and excessive play in pivot bearings, while the associated uncontrolled vibrations are also prevented.

19 Claims, 3 Drawing Figures

DEVICE FOR HONING WORKPIECES

BACKGROUND OF THE INVENTION

1. Field of the Invention

The present invention relates to a device for honing workpieces, particularly the surface of a cylindrical workpiece bore; the device includes a rotatable and axially reciprocable honing tool which is guided by an upper and a lower end section in corresponding bearings of a workholding fixture, and also includes a drive rod which is disposed between the honing tool and a machine spindle, and which is at least partially movable transverse to its axial direction.

2. Description of the Prior Art

In a known device of this type, the honing tool is guided with little play in a device with floating workpieces in rigid bearings which are disposed on opposite sides of the workpieces. The drive rod is suspended from swivel joints; i.e., it is connected to the machine spindle and the honing tool by respective ball and socket joints.

Due to the necessary play in the ball and socket joints of the drive rod, the feed force is increased when the stroke is reversed at the lower reversing point, and is reduced at the upper reversing point. When machining high-precision bores, such as the bores of an injection pump part, this may possibly diminish the obtainable accuracy. There is also the fact that the relatively large mass of the ball and socket joints, in conjunction with the aforementioned play and the high rotational speeds of the honing tool, may lead to an out-of-balance which results in uncontrolled vibrations and prevents the workpieces from being manufactured with the necessary extremely high accuracy.

It is an object of the present invention to design a device of this general type in such a way that uncontrolled vibrations caused by out-of-balance, as well as a change in the feed force when the stroke is reversed, are prevented, and high-precision machining of the workpieces is made possible.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
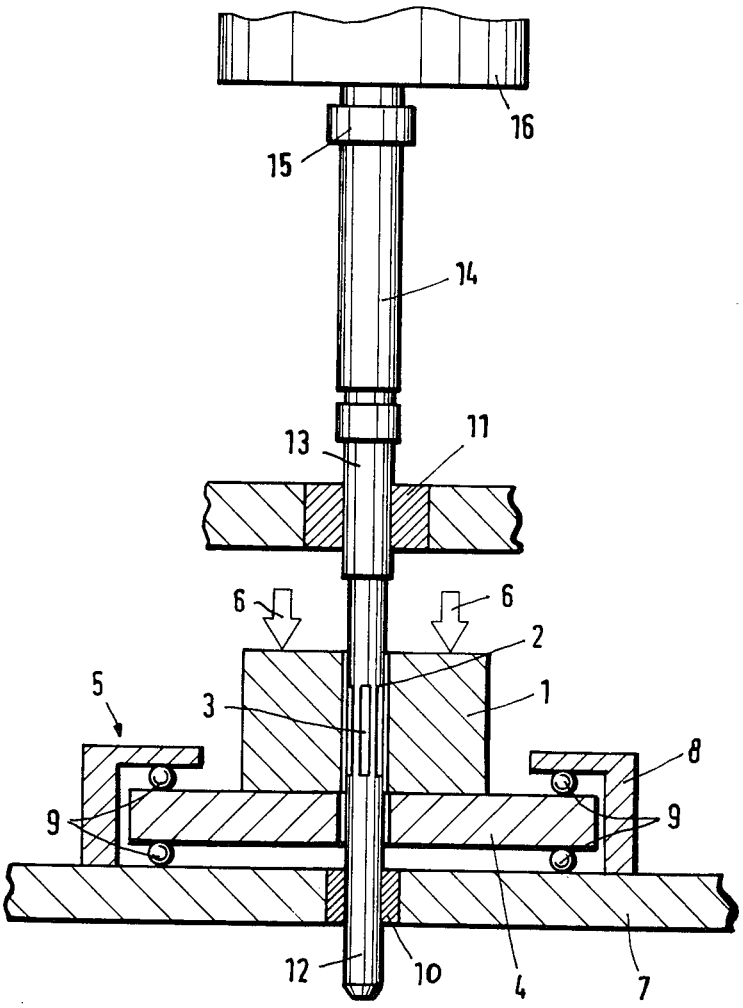
FIG. 1 shows an axial section through one embodiment of a honing device according to the invention with a workpiece braced against a floating plate.

The device of the present invention is characterized primarily in that the drive rod is flexible in the radial direction. The flexible design of the drive rod renders the upper and lower swivel bearings superfluous, so that the dirve rod is lighter by at least the weight of the bearings. However, the elimination of the ball and socket joints is also accompanied by the elimination of their relatively great play, with the result that out-of-balance at high rotational speeds of the honing tool as a result of excessive mass and excessive play, as well as the associated uncontrolled vibrations, are prevented. Furthermore, the absence of play in the bearings guarantees that there is no change in the feed action when the stroke is reversed at the lower reversing point and at the upper reversing point. Consequently, the machining accuracy can be considerably improved with the device according to the invention, so that the device is particularly suitable for making bores which must be machined to high precision, such as the bores of injection pump parts.

Pursuant to further advantageous specific features of the present invention, the drive rod may comprise at least two telescopically interlocking tubular pieces which are connected to one another in such a way that they cannot move axially and cannot turn with respect to one another, with one tubular piece being connected to the machine spindle, and the other tubular piece being connected to the honing tool. The inner and outer tubular pieces may be connected by an intermediate tube. A screw connection may be provided between the inner and outer tubular pieces in such a way that the ends of the intermediate tube have male and female threaded sections which mate with corresponding threaded sections of the tubular pieces.

The intermediate tube may be provided with radial play in the outer tubular piece, and the inner tubular piece may be provided with radial play in the intermediate tube. The outer and inner tubular pieces may be limited radially by stops. A stop in the form of a stop ring may be attached to the lower end of the outer tubular piece, said stop ring having a conical inside surface. The inside surface may be associated with a corresponding conical outside surface of a radial collar of a thicker end section of the inner tube. A damping part, a rubber-elastic ring, or the like may be disposed between the outside and inside surfaces.

The stop ring may be held on the outer tubular piece by a lock nut.

The end section of the inner tubular piece may be connected to a collet for the tool, said collet projecting into a bore of the inner tubular piece.

The intermediate tube and/or the inner tubular piece may be at least partially slotted. The inner tubular piece and the intermediate tube may each have at least one, preferably two, diametrically opposed openings which extend axially in the region between the threaded connections. The openings may be offset with respect to one another in the circumferential direction of the inner tubular piece and the intermediate tube. The openings of the inner tubular piece may extend over approximately a quarter of the circumference of the tube.

The openings of the intermediate tube may be wider in the circumferential directon than those of the inner tubular piece. Provided between two openings of the intermediate tube may be longitudinal webs, the circumferential width of which is approximately equal to the width of the openings of the inner tubular piece.

DESCRIPTION OF A PREFERRED EMBODIMENT

Referring now to the drawings in detail, the honing device in FIG. 1 exhibits a workpiece 1 with a bore 2 which is being machined by a honing tool 3. To this end, the workpiece 1 is braced in known manner on a floating plate 4 of a workholding fixture 5; this is indicated by the arrows 6. The floating plate 4 is disposed in a housing 8 with at least two spaced-apart balls 9 on either side of it, whereby the floating plate 4 is able to move transversely to the longitudinal axis of the honing tool 3, but is rigidly held in the axial direction. The housing 8, in turn, is mounted on a rigid base plate 7.

Disposed above and below the workholding fixture 5 in a known manner are rigid or fixed guide bearings 10 and 11 which are engaged with little radial play by the corresponding cylindrical end sections 12 and 13 of the honing tool 3. This guarantees extremely accurate holding and guiding of the honing tool.

The honing tool 3 is connected to a machine spindle 15 of a honing machine 16 through the intermediary of a radially flexible drive rod 14 of a rotating and reciprocating drive.

Figure 2:
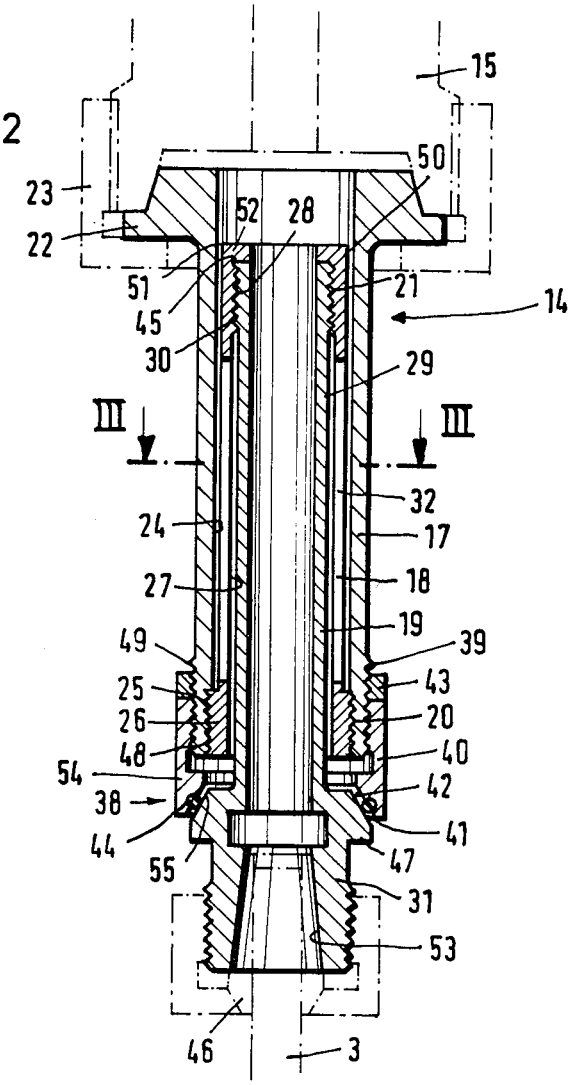
FIG. 2 shows an axial section through a drive rod of the device according to FIG. 1.
Figure 3:
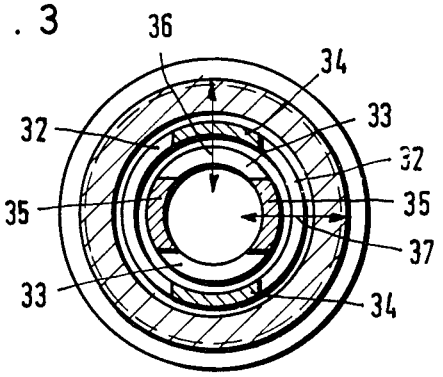
FIG. 3 shows a section taken along line III—III in FIG. 2.

As shown in FIGS. 2 and 3, the drive rod 14 comprises three telescopically interlocking, screw-connected tubes, namely an outer tube 17, an inner tube 19, and an intermediate tube 18 which connects the inner and outer tubes. The tubes 17 and 19 are connected to the machine spindle 15 and to the honing tool 3 respectively in such a way that they cannot turn. One end 48 of the intermediate tube 18 is screw-connected by means of a thread 20 to that end 49 of the outer tube 17 facing away from the machine spindle 15, while its other end 50 is screw-connected by means of a thread 21 to that end 51 of the inner tube 19 facing the machine spindle 15, so that the tubes 17 to 19 are rigidly connected to each other in the axial direction, and hence in their direction of rotation.

The outer tube 17 has an upper end 22 which broadens out in the manner of a flange and which is rigidly connected to the machine spindle 15 throgh the intermediary of a union nut 23. At the opposite end 49 of the outer tube 17, its continuous bore 24 merges via shouldered steps into a threaded section 25 of wider diameter. A radially outwardly projecting threaded section 26 of the intermediate tube 18 is screwed into the threaded section 25.

The intermediate tube 18 extends inside the bore 24 in the direction of the end 22 of the outer tube 17. The outer diameter of the intermediate tube 18 is less than the inside diameter of the bore 24, so that the intermediate tube has radial play in the bore. A likewise continuous bore 27 of the intermediate tube 18 has an internal or female threaded section 28 at that end opposite the threaded section 26. The female threaded section 28 ends at a radially inwardly directed collar 45 of the intermediate tube 18.

A thin-walled tubular section 29 of the inner tube 19 projects into the bore 27 and has approximately the same wall thickness as the intermediate tube 18. This tubular section 29 of the inner tube 19 is screwed by means of an external or male thread 30 into the threaded section 28 to form the threaded connection 21.

The tubular section 29 of the inner tube 19 projects downwards beyond the outer tube 17 and the intermediate tube 18 and, immediately outside the bore 27 of the intermediate tube 18, becomes a radially outwardly projecting circumferential or continuous collar 47 before finally merging into a substantially thicker end section 31. The latter has a conical, downwardly widening bore 53 in which a known collet 46 is held. The honing tool 3 is clamped in the collet 46. The outer diameter of the tubular section 29 of the inner tube 19 is less than the inside diameter of the bore 27, so that the inner tube 19 has radial play in the bore 27.

As shown in FIG. 3, the walls of the intermediate tube 18 and of the tubular section 29 of the inner tube 19 each have two diametrically opposed, axially extending slotted openings 32 and 33 in the region between the threaded connections 20 and 21. The edge sections remaining between the openings likewise form diametrically opposed webs 34 and 35, with the webs 34 of the intermediate tube 18 being offset by 90° to the webs 35 of the inner tube 19. The webs 34 and the webs 35 are flexible in directions which are perpendicular to each other (arrows 36 and 37), so that the outer tube 17 has zero-play universal-joint-like mobility in relation to the inner tube 19. Each of the openings 33 of the inner tube 19 extends over about a quarter of the circumference of the inner tube, while the openings 32 of the intermediate tube 18 have approximately twice the circumferential width. The webs 34 and 35 of the tubes 18 and 19 have approximately the same width in the circumferential direction.

An adjustable stop means 38 is provided for limiting and adjusting the radial mobility of the tubes 17 to 19 with respect to one another. The stop means comprises a stop ring 40 which is connected to the outer tube by means of a thread 39 in such a way that it is axially adjustable. The stop ring 40 interacts with a conical outside surface 41 of the inner tube 19, said outside surface being inclined at an angle of about 45° in the axial direction of the drive rod 14. For this purpose, that end section 54 of the stop ring 40 which projects over the end 49 of the outer tube 17 has a conical inside surface 42. The inside surface 42 overlaps the outside surface 41 which is parallel to it and which is disposed on the end section 31 of the inner tube 19.

Between the outside and inside surfaces 41 and 42 there is an air gap 55, the width of which can be adjusted in a simple manner by turning the stop ring 40 and can be fixed with the lock nut 43 in order to set the radial mobility of the two tubes 17 and 19 with respect to one another.

Disposed between the outside and inside surfaces 41 and 42 is a damping part which is preferably in the form of an elastic ring 44, and by means of which any desired vibrations can be suppressed.

Instead of the webs 34 and 35, it is possible to use flexible parts, such as spring steel bands, which rigidly connected to appropriately matched connecting pieces by means of screws, soldering, or similar means.

The present invention is, of course, in no way restricted to the specific disclosure of the specification and drawings, but also encompasses any modifications within the scope of the appended claims.

What we claim is:

1. A device for honing workpieces, comprising:

a workholding fixture;

bearings associated with said workholding fixture;

a rotatable and axially reciprocable honing tool having upper and lower end sections which are respectively guided in one of said bearings which are associated with said workholding fixture;

a machine spindle; and a drive rod disposed between and connected to said honing tool and said machine spinlde, said drive rod for radial mobility in equalization of axial misalignment between said machine spindle and said honing tool being at least partially movable transverse to its axial direction, and being flexible in the radial direction; said drive rod comprising at least two telescopically interlocking tubular pieces which are connected to one another with zero-play universal-joint-like mobility in such a way that they cannot move axially and cannot turn with respect to one anothr although a great radial yielding capability is attained so that radial mobility exists whereby greater axial misalignment between said machine spindle and said honing tool can be equalized, with one of said tubular pieces being connected to said machine spindle, and another of said tubular pieces being connected to said honing tool; said tubular pieces including an inner tube, an intermediate tube, and an outer tube, with said inner and outer tubes being interconnected by means of said intermediate tube; said intermediate tube effecting said interconnection of said inner and outer tubes by means of a predetermined connection, with said intermediate tube having ends provided with fastening means which mate with corresponding fastening sections of said outer and inner tubes.

2. A device according to claim 1, in which said drive rod comprises at least two telescopically interlocking tubular pieces which are connected to one another with zero-play universal-joint-like mobility in such a way that they cannot move axially and cannot turn with respect to one another although a great radial yielding capability is attained so that radial mobility exists whereby greater axial misalignment between said machine spindle and said honing tool can be equalized, with one of said tubular pieces being connected to said machine spindle, and another of said tubular pieces being connected to said honing tool.

3. A device according to claim 2, in which said tubular pieces include an inner tube, an intermediate tube, and an outer tube, with said inner and outer tubes being interconnected by means of said intermediate tube.

4. A device for honing workpieces, comprising:

a workholding fixture;

bearings associated with said workholding fixture;

a rotatable and axially reciprocable honing tool having upper and lower end sections which are respectively guided in one of said bearings which are associated with said workholding fixture;

a machine spindle; and a drive rod disposed between and connected to said honing tool and said machine spindle, said drive rod for radial mobility in equalization of axial misalignment between said machine spindle and said honing tool being at least partially movable transverse to its axial direction, and being flexible in the radial direction; said drive rod comprising at least two telescopically interlocking tubular pieces which are connected to one another with zero-play universal-joint-like mobility in such a way that they cannot move axially and cannot turn with respect to one another although a great radial yielding capability is attained so that radial mobility exists whereby greater axial misalignment between said machine spindle and said honing tool can be equalized, with one of said tubular pieces being connected to said machine spindle, and another of said tubular pieces being connected to said honing tool; said tubular pieces including an inner tube, an intermediate tube, and an outer tube, with said inner and outer tubes being interconnected by means of said intermediate tube; said intermediate tube effecting said interconnection of said inner and outer tubes by means of a screw connection, with said intermediate tube having ends provided with threads which mate with corresponding threaded sections of said outer and inner tubes.

5. A device according to claim 4, in which said intermediate tube is provided with radial play in said outer tube, and said inner tube is provided with radial play in said intermediate tube.

6. A device according to claim 5, in which said outer and inner tubes are limited radially by means of a stop arrangement.

7. A device according to claim 6, in which said outer tube has a lower end remote from said machine spindle; and in which said stop arrangement includes a stop ring attached to said lower end of said outer tube, said stop ring having a conical inside surface.

8. A device for honing workpieces, comprising:

a workholding fixture;

bearings associated with said workholding fixture;

a rotatable and axially reciprocable honing tool having upper and lower end sections which are respectively guided in one of said bearings which are associated with said workholding fixture;

a machine spindle;

a drive rod disposed between and connected to said honing tool and said machine spindle, said drive rod being at least partially movable transverse to its axial direction, and being flexible in the radial direction;

said drive rod comprising at least two telescopically interlocking tubular pieces which are connected to one another in such a way that they cannot move axially and cannot turn with respect to one another, with one of said tubular pieces being connected to said machine spindle, and another of said tubular pieces being connected to said honing tool;

said tubular pieces including an inner tube, an intermediate tube, and an outer tube, with said inner and outer tubes being interconnected by means of said intermediate tube;

said intermediate tube effecting said interconnection of said inner and outer tubes by means of a screw connection, with said intermediate tube having ends provided with threads which mate with corresponding threaded sections of said outer and inner tubes;

said intermediate tube being provided with radial play in said outer tube, and said inner tube being provided with radial play in said intermediate tube;

said outer and inner tubes being limited radially by means of a stop arrangement;

said outer tube having a lower end remote from said machine spindle;

said stop arrangement including a stop ring attached to said lower end of said outer tube, said stop ring having a conical inside surface; and said inner tube having a thicker end section remote from said machine spindle, said end section including a radially extending collar which is provided with a conical outside surface which cooperates with said conical inside surface of said stop ring.

9. A device according to claim 8, which includes a damping part disposed between said cooperating conical surfaces of said collar and said stop ring.

10. A device according to claim 9, in which said damping part is a rubber-elastic ring.

11. A device according to claim 8, which includes a lock nut for holding said stop ring on said outer tube.

12. A device according to claim 8, in which said thicker end section of said inner tube is provided with a bore; and in which connection of said honing tool to said drive rod is effected by a collet which is associated with said honing tool and projects into said bore of said thicker end section of said inner tube.

13. A device according to claim 8, in which at least one of said intermediate tube and said inner tube is at least partially slotted.

14. A device according to claim 13, in which each of said intermediate tube and said inner tube is provided with at least one slot-like opening which extends axially in the region between said threaded sections of said outer and intermediate tubes and said intermediate and inner tubes respectively.

15. A device according to claim 14, in which each of said intermediate tube and said inner tube is provided with two diametrically opposed slot-like openings.

16. A device according to claim 15, in which said openings of said intermediate tube are offset relative to said openings of said inner tube in the circumferential direction of said inner and intermediate tubes.

17. A device according to claim 16, in which said openings of said inner tube extend over approximately one fourth of the circumference thereof.

18. A device according to claim 17, in which said openings of said intermediate tube are wider in the circumferential direction than are said openings of said inner tube.

19. A device according to claim 18, in which said intermediate tube is provided between said openings thereof with respective webs which extend in the longitudinal direction and have a circumferential width which is approximately equal to the width of said openings of said inner tube.

* * * * *